United States Patent [19]

Hunter

[11] Patent Number: 4,589,467

[45] Date of Patent: May 20, 1986

[54] MOLD HANDLING SYSTEM

[75] Inventor: William A. Hunter, Inverness, Ill.

[73] Assignee: Hunter Automated Machinery Corporation, Schaumburg, Ill.

[21] Appl. No.: 649,595

[22] Filed: Sep. 12, 1984

Related U.S. Application Data

[63] Continuation-in-part of Ser. No. 636,817, Aug. 1, 1984.

[51] Int. Cl.[4] ..... B22D 5/02

[52] U.S. Cl. ..... 164/326; 164/322; 198/346.1; 198/478.1; 414/787

[58] Field of Search ..... 414/102, 787; 164/130, 164/324, 325, 326, 329, 322; 198/339, 480, 346.1, 478.1

[56] References Cited

U.S. PATENT DOCUMENTS

| | | | |
|---|---|---|---|
| 2,023,040 | 12/1935 | Adams, Jr. | 164/326 X |
| 3,068,537 | 12/1962 | Fellows | 164/324 |
| 3,268,098 | 8/1966 | Thomas et al. | 414/280 |
| 3,659,644 | 5/1972 | De Bie | 164/326 |
| 3,682,236 | 8/1972 | Becke | 164/324 |
| 3,703,921 | 11/1972 | Hunter | 164/130 |
| 3,955,613 | 5/1976 | Lund | 164/130 |
| 3,983,991 | 10/1976 | Shields | 164/326 X |
| 3,989,094 | 11/1976 | Gorenflo et al. | 164/324 |
| 4,422,495 | 12/1983 | Van Nette, III | 164/324 |

FOREIGN PATENT DOCUMENTS

| | | | |
|---|---|---|---|
| 3026525 | 2/1982 | Fed. Rep. of Germany | 164/326 |

*Primary Examiner*—Robert J. Spar
*Assistant Examiner*—Ken Muncy
*Attorney, Agent, or Firm*—Leydig, Voit & Mayer, Ltd.

[57] ABSTRACT

A mold handling system comprising an indexing turntable for carrying a multiplicity of molds in concentric inner and outer rings with the outer ring located at a lower elevation than the inner ring, a conveyor for transporting a multiplicity of molds to a mold transfer station adjacent the turntable, the transfer station including a mold transfer shuttle having a tandem pair of pusher plates for simultaneously (1) transferring a mold from the radial location of the outer ring of molds to the radial location of the inner ring of molds on the turntable, and (2) transferring a new mold from the conveyor to the radial location of the outer ring of molds, the pusher plates directly engaging the respective molds transferred thereby, an elevator mechanism for transporting molds back and forth between the different elevations, the upward movement of the elevator mechanism lifting a mold from the outer ring to the elevation of the inner ring so that the shuttle mechanism transfers the lifted mold directly from the elevator mechanism to the inner ring while simultaneously transferring a new mold from the conveyor onto the elevator mechanism, and the downward movement of the elevator mechanism lowers the new mold into the outer ring, a pouring station adjacent the turntable at a position downstream of the transfer station for filling the molds on the turntable with molten metal, and a mold discharge station for removing molds from the turntable.

8 Claims, 16 Drawing Figures

75
74
76
80
74a
79
70
90
91
93
71
82
87
84
86
85
83
81
87
80
76
79
17
78
77
M
16
73
72
52
51

71
79
76
81
87
83
86

14
S12
S11
S13
18
19a
14
146
14c
19
100a
101
S14
146
14a
S27
S28
S29
S26
14c
146
S25
25
24
S15
100
26
103
23
105
S16
20
S1
S17
S21
S20
S19
S18
14
S2
S3
S5
S4
S6

MOLD HANDLING SYSTEM

CROSS-REFERENCE TO RELATED APPLICATION

This application is a continuation-in-part of my copending U.S. patent application Ser. No. 636,817 filed Aug. 1, 1984, entitled "MOLD HANDLING SYSTEM."

BACKGROUND OF THE INVENTION

The present invention relates to automated mold handling systems for handling foundry molds during such operations as weight setting, metal pouring, cooling, dumping and the like. A prior art system for this purpose is described in Hunter U.S. Pat. No. 3,703,921, entitled "Method and Apparatus for casting in Molds Radially Displaced on Rotating Table."

SUMMARY OF THE INVENTION

It is a primary object of the present invention to provide an improved automated mold handling system which is highly efficient in its operation and which is capable of providing a high level of productivity per dollar of capital investment.

A further object of this invention is to provide an improved mold handling system which provides relatively simple mechanisms for manipulating the molds, thereby providing a system which is relatively economical to manufacture. A related object is to provide such a system which is extemely rapid in its operation.

It is another object of this invention to provide such an improved mold handling system which significantly reduces the possibilities of damaging the molds during their handling, and which particularly reduces the chances of damaging soft molds prior to the pouring of molten metal into the molds. In this connection, one specific object of the invention is to provide such a system which prevents the molds from contacting each other.

Other objects and advantages of the invention will be apparent from the following detailed description and the accompanying drawings.

In accordance with the present invention, the foregoing objectives are realized by a mold handling system comprising an indexing turntable for carrying a multiplicity of molds in concentric inner and outer rings; a conveyor for transporting a multiplicity of molds to a mold transfer station adjacent the turntable, the transfer station including a mold-transfer shuttle having a tandem pair of pusher plates for simultaneously (1) transferring a mold from the radial location of the outer ring of molds to the radial location of the inner ring of molds on the turntable, and (2) transferring a new mold from the conveyor to the radial location of the outer ring of molds, the pusher plates directly engaging the respective molds transferred thereby; a pouring station adjacent the turntable at a position downstream of the transfer station for filling the molds on the turntable with molten metal; and a mold discharge station for removing molds from the turntable.

While the invention will be described in connection with certain preferred embodiment, it will be understood that it is not intended to limit the invention to those particular embodiments. On the contrary, it is intended to cover all alternatives, modifications and equivalent arrangements as may be included within the spirit and scope of the invention as defined by the appended claims.

DESCRIPTION OF THE PREFERRED EMBODIMENT

Figure 1:
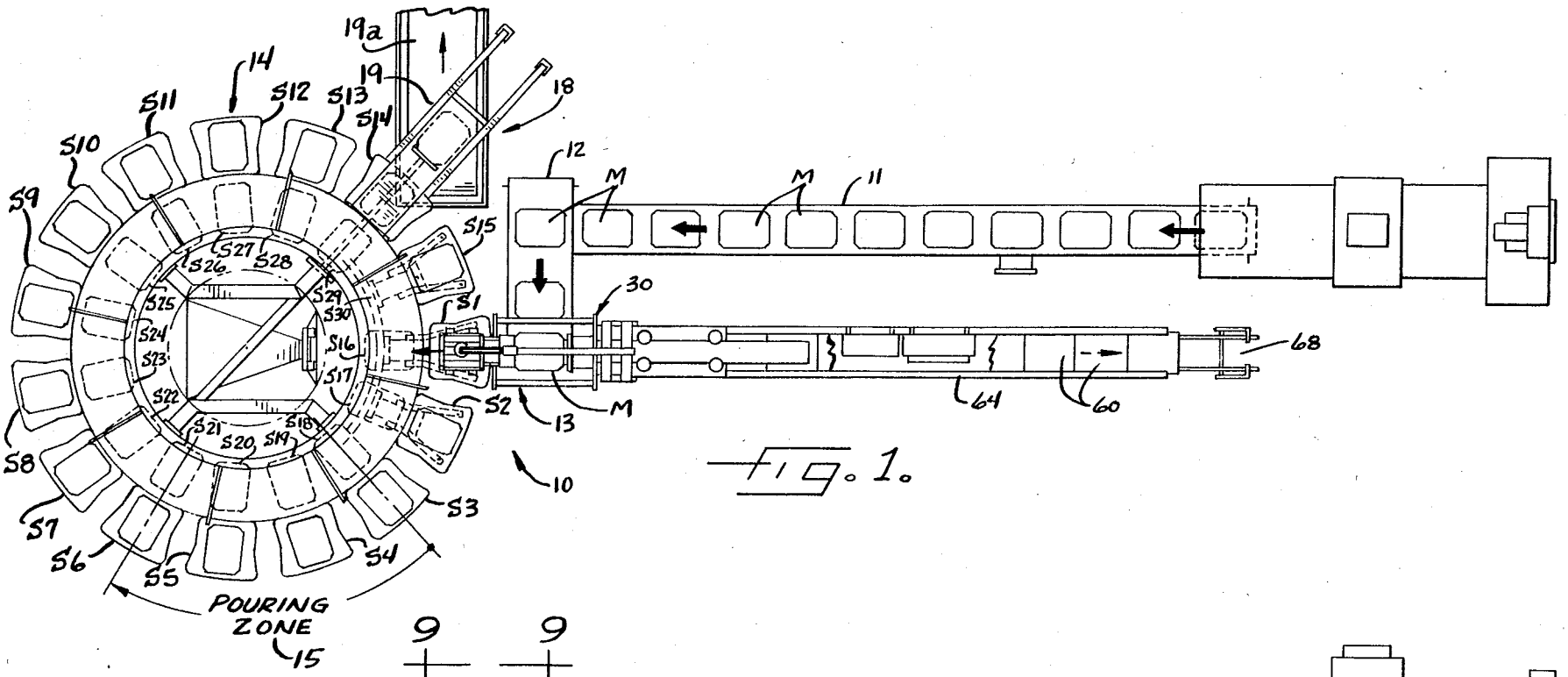
FIG. 1 is a top plan view of a mold handling system embodying the invention.
Figure 2:
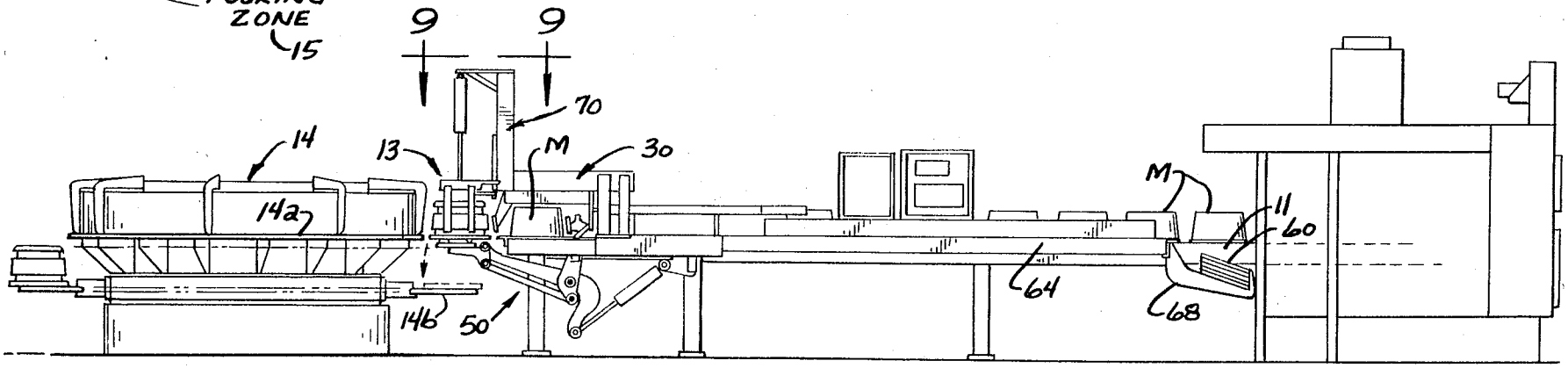
FIG. 2 is a side elevation of the mold handling system shown in FIG. 1.

Turning now to the drawings and referring first to FIGS. 1 and 2, there is shown a mold handling system 10 for continually receiving molds M which are conveyed in seriatim on a roller conveyor 11 from a conventional mold forming or storage location. The molds M can be made in a conventional mold-making machine, examples of which are described in Hunter U.S. Pat. No. 3,406,738 for "Automatic Matchplate Molding Machine"; Hunter U.S. Pat. No. 3,506,058 for "Method of Matchplate Moulding"; Hunter U.S. Pat. No. 3,520,348 for "Fill Carriages for Automatic Matchplate Moulding Machines"; and Hunter U.S. Pat. No. 4,156,450 for "Foundry Machine and Method and Foundry Mold Made Thereby."

As the new molds M reach the end of the conveyor 11, they are transported laterally on a second roller conveyor 12 to a transfer station 13. In the illustrative system, the molds M are advanced along the conveyor 12 by gravity and are stopped at the transfer station 13 by a row of mechanical stops 12*a*.

At the transfer station 13, the molds M are transferred one at a time onto a two-tiered turntable 14. This turntable is in the form of an annulus having a large number of mold stations S1–S15 disposed in an outer circular array or ring on the lower tier, and an equal number of mold stations S16–S30 arranged in an inner circular array or ring on the upper tier. The mold stations on the upper tier are formed on a solid annular plate 14*a*, while the mold stations on the lower tier are formed by a pair of mold-suppporting arms 14*b* interconnected by a cross member 14*c*. The turntable 14 is indexed to bring successive mold stations thereon to rest adjacent the transfer station 13. In the particular example illustrated, the turntable 14 has a total of fifteen mold stations in each ring, and thus fifteen indexing steps move the turntable 14 through one complete revolution.

From the transfer station 13, the mold is indexed through a pouring zone 15, which in the illustrated embodiment encompasses a total of four adjacent mold stations S3–S6 on the turntable 14. This pouring zone 15 can, of course, be adjusted to encompass any desired number of mold stations. Molten metal may be poured into the molds from conventional furnaces, either automatically or manually, at any of the stations within this pouring zone 15. After the mold has been filled with molten metal, it begins to cool as the mold continues to be indexed back toward the transfer station 13. At the transfer station, the partially cooled molds are transferred from the outer ring of the turntable (on the lower tier) onto the inner ring of the turntable (on the upper tier).

All the molds in the outer ring are equipped with conventional jackets 16 and weights 17 which hold the cope and drag sections of the mold firmly together until the mold has been filled with metal and that metal has at least partially solidified. By the time a mold has completed one revolution in the outer ring of molds on the turntable, the metal has cooled sufficiently that it is safe to remove the jacket and weight. As will be described in more detail below, this removal is effected automatically in the illustrative system before each mold is transferred to the inner ring; thus, the molds in the inner ring carry no jackets or weights.

To remove the molds from the upper tier of the turntable 14 at the end of the desired cooling period, the turntable 14 passes through a mold discharge station 18 which includes a mold removal mechanism for moving molds radially outwardly from the upper tier of the inner turntable into a discharge chute 19. The chute 19 guides the molds onto a conveyor 19*a* which delivers the molds to a conventional shakeout mechanism for separating the solidified casting from the molding sand.

The two-tier turntable arrangement is advantageous for several reasons. First of all, having the new molds carried on the lower tier means that the pouring of hot molten metal into the molds can be carried out relatively close to the floor of the foundry, which is safer than pouring the hot molten metal at a higher location. Secondly, when the molds on the upper tier of the turntable are ready to be unloaded from the turntable (after they have been carried around both the outer ring and the inner ring to allow the metal therein to cool sufficiently to at least partially solidify), the fact that the inner ring of molds is located above the outer ring facilitates the removal of molds from the inner ring because they can be simply transferred outwardly over the molds in the outer ring.

To drive the turntable 14, a gear motor 20 (FIG. 4) is connected via a Geneva drive mechanism 21 to an annular plate 22 extending around the inner periphery of the turntable. More specifically, the motor 20 rotates a Geneva-type drive arm 23 having a follower roller 24 mounted on one end thereof. As the drive arm 23 is rotated with the motor output shaft, the roller 24 passes in and out of radial slots formed by fifteen pairs of index tracks 25, 26 (FIG. 3) affixed to the top surface of the annulus 22 to produce the desired intermittent or indexing movement of the turntable.

Each revolution of the drive arm 23 indexes the turntable 14 by one-fifteenth of a revolution, thereby causing each mold station on the turntable to be indexed progressively through the transfer station 13. The drive arm 23 is stopped following each revolution, at a time when the roller 24 is outside the radial slots, to provide a dwell interval during which a cycle of mold-transferring operations are carried out at the transfer station, metal is poured into one of the molds in the pouring zone 15, and a mold is discharged from the upper tier of the turntable 14 at the discharge station 18. This dwell time must, of course, be long enough to permit all the aforementioned operations to be carried out. The faster those operations can be carried out, the shorter the dwell time, and the greater the productivity of the machine.

In accordance with one important aspect of the invention, a mold-transferring shuttle mechanism 30 at the transfer station 13 simultaneously (1) transfers a mold M from the radial location of the outer ring of molds to the radial location of the inner ring of molds on the turntable 14 and (2) transfers a new mold from the conveyor 12 to the radial location of the outer ring of molds. The shuttle mechanism 30 which effects this simultaneous transfer includes a tandem pair of pusher plates 31 and 32 for directly engaging both of the molds to be transferred. This direct and concurrent mechanical engagement of both molds by the shuttle mechanism permits rapid and reliable transferring movement of the molds, ensures accurate positioning of the molds even though they are spaced from each other, and avoids any distortion of the molds due to the forces exerted thereon during the transferring movement.

In the preferred embodiment of the invention, the transfer station also includes an elevator mechanism for lifting a mold from the outer ring of the turntable to the level of the inner ring of molds on the turntable, for receiving a new mold from the shuttle, and for lowering the new mold into the outer ring of molds on the turntable. This elevator mechanism is actuated each time the turntable is indexed to bring a new mold station into alignment with the transfer station. It is the mold lifted by this elevator mechanism that is then transferred to the upper tier of the turntable by the tandem shuttle simultaneously with the transfer of a new mold onto the elevator mechanism.

Turning now to FIGS. 3–8 for a more detailed description of the mold-transferring shuttle mechanism 30, the two molds to be transferred are directly engaged by the tandem pusher plates 31 and 32 cantilevered from a shuttle carriage 33. This carriage 33 is mounted for reciprocating movement along a projected radius of the turntable 14 in response to advancing and retracting movement of the pistons by a pair of tandemly mounted pneumatic cylinders 34 and 35. The longer pneumatic cylinder 34 is used to effect the principal portion of the advancing and retracting movements of the shuttle carriage. The shorter cylinder 35 is used primarily to effect an intermediate retracting movement of the carriage, as will be described in more detail below.

To support and guide the shuttle carriage 33 during its reciprocating movement, a main center rib 36 of the carriage carries a pair of elongated rails 37 which ride in a set of four rollers 38 having grooved surfaces for receiving the rails 37. The rollers 38 are mounted on a stationary part of the machine frame.

One end of the main rib 36 of the carriage is fastened to a cross plate 39, which is also fastened to one end of the tandemly mounted cylinders 34 and 35. This cross plate 39 also carries a pair of long cantilevered arms 40 and 41 which support the front pusher plate 31, and a pair of short cantilevered arms 42 and 43 which support the rear pusher plate 32. As can be seen most clearly in FIG. 3, the cantilevered arms 40 and 41 supporting the front pusher plate 31 are spaced far enough apart that they straddle the mold being pushed by the rear pusher plate 32.

The elevator mechanism 50 for transferring molds between the levels of the two tiers of the turntable is also illustrated most clearly in FIGS. 3–8. This elevator mechanism comprises a platform 51 having three spaced recesses 51*a*, 51*b* and 51*c* for receiving three mating feet on the underside of a mold support plate 52. The elevator platform 51 is mounted on a platform carrier 53, which in turn is pivoted to the ends of an arm 54 and a strut 55, both of which are pivotally mounted between a pair of plates 56 depending from a stationary frame member 57. The outboard end of the arm 54 is connected to the piston rod of a pneumatic cylinder 58 which is actuated to raise and lower the elevator platform 51 and its carrier 53 by pivoting the arm 54. As can be seen most clearly in FIG. 4, the arm 54 and the strut 55, and their pivot points, are dimensioned and positioned to maintain the platform carrier 53 horizontal throughout the full range of its vertical travel.

Figure 4:
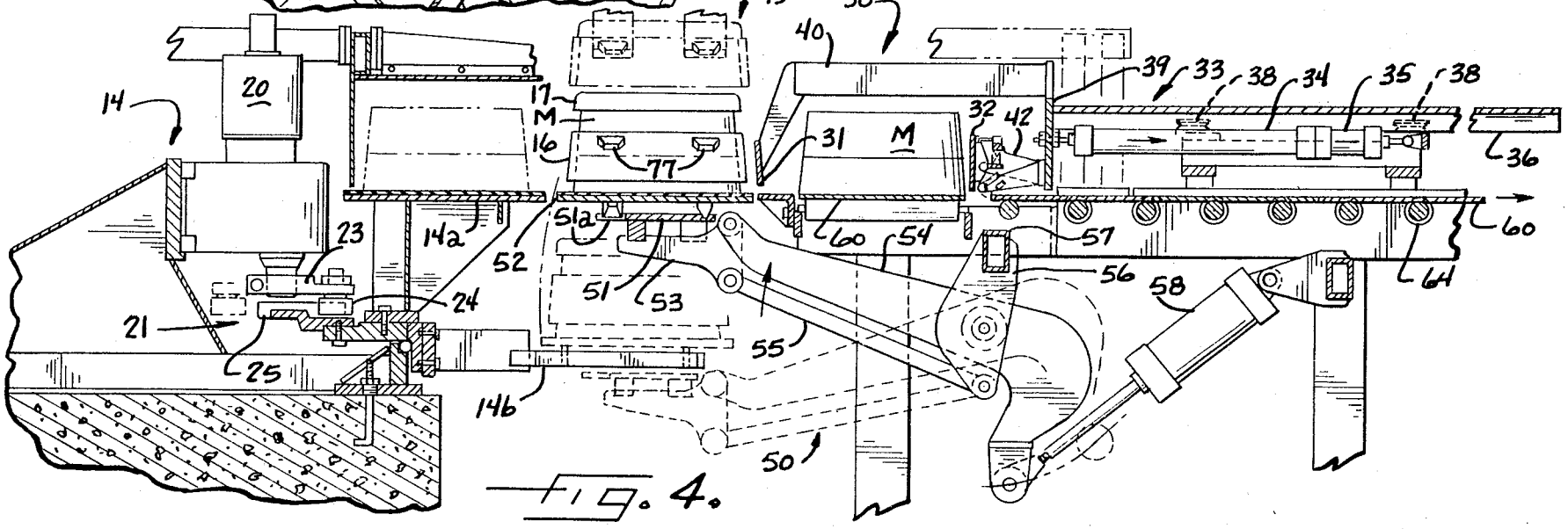
FIG. 4 is a section taken generally along 4—4 in FIG. 3.

In FIG. 4, the elevator mechanism 50 is shown in its raised position in solid lines, and in its lowered position in broken lines. As the elevator platform 51 is moved upwardly from its lowered position to its raised position, it passes between the mold-supporting arms 14*b* of the lower tier of the turntable, lifts the mold M and its support plate 52 from their supporting arms, and transports the mold and support plate to the level of the upper tier of the turntable. During this upward movement of the elevator mechanism, the transfer shuttle 30 is in its fully retracted position, as illustrated in FIG. 4.

Figure 3:
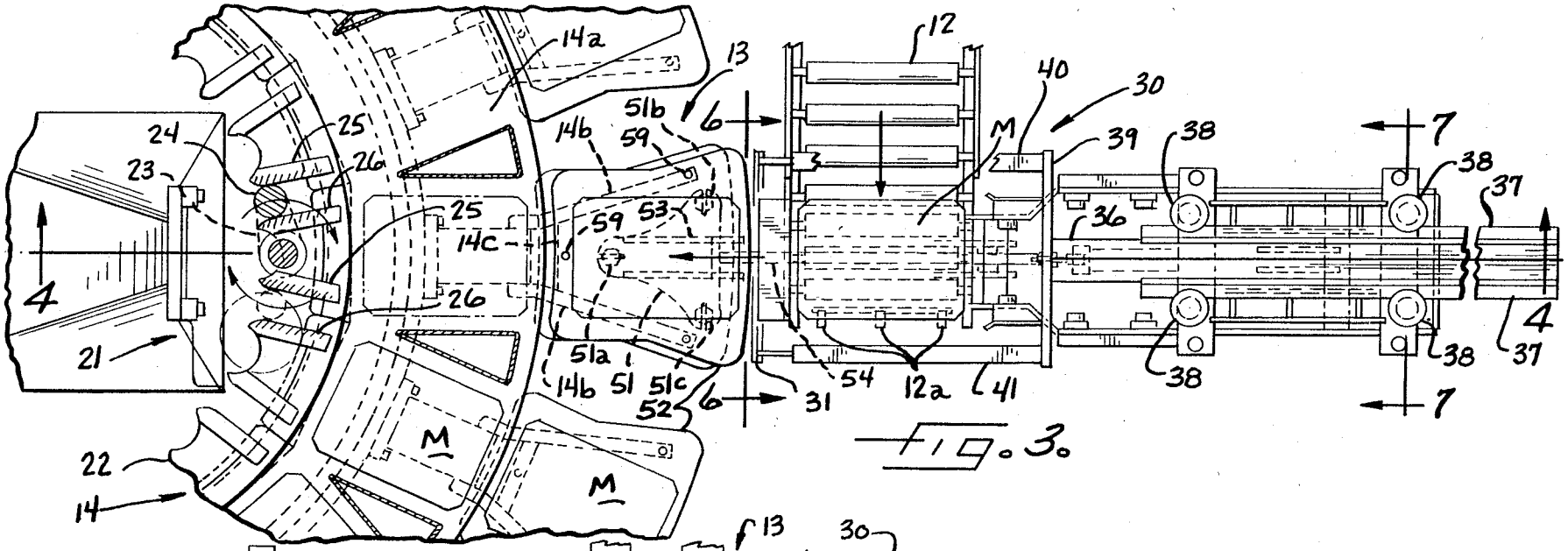
FIG. 3 is an enlarged top plan view, partially in section, of a portion of the system shown in FIG. 1.
Figure 5A:
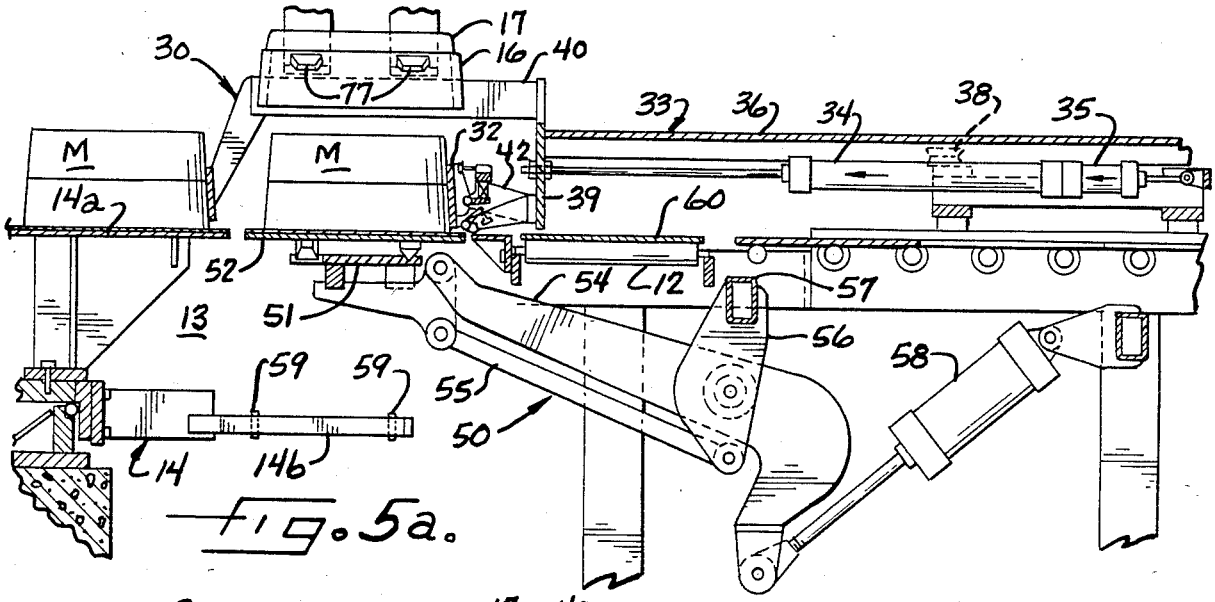
FIGS. 5*a*, 5*b* and 5*c* comprise a series of sectional views similar to FIG. 4 but showing the system in different stages of an operating cycle.

After the elevator platform 51 has been raised to its uppermost position, where the mold support plate 52 is at the same height as similar plates on the upper tier of the turntable, the jacket 16 and weight 17 are removed from the mold on the elevator platform. This jacket and weight removal is illustrated in FIG. 5*a* and is effected by lifting the jacket off the mold by an overhead jacket transfer mechanism which will be described in more detail below. As the jacket 16 is raised, the top of the jacket engages the overhanging portion of the weight 17 resting on the top of the mold, so that continued upward movement of the jacket also elevates the weight. As can be seen in FIG. 3, the space between the cantilevered arms 40 and 41 supporting the front pusher plate 31 is large enough to permit the mold jacket and weight to pass vertically between those arms.

After the jacket and weight have been lifted off the mold on the elevator platform 51, the tandem transfer shuttle is moved to its fully advanced position shown in FIG. 5*a* by fully extending the piston rods of both the pneumatic cylinders 34 and 35. During this advancing movement, the rear pusher plate 32 transfers the new mold from the conveyor 12 to the mold support plate 51 on the elevator platform 51, and the front pusher plate 31 transfers the mold on the elevator to the upper tier of the turntable. This latter mold, of course, has already been carried on the lower tier of the turntable for one complete revolution, during which it was filled with molten metal and then partially cooled.

As can be seen in FIG. 5*a*, both the pusher plates 31 and 32 are tilted slightly to match the taper angle of the mold side walls which they engage. This angle is typically about four degrees. The front pusher plate 31 is rigidly mounted in this canted position, while the rear plate 32 is pivotally mounted on its arms 40, 41 so that it can conform to the exact taper of the side wall of the new mold. This feature ensures that the new mold, which has not yet been filled with molten metal and may even be somewhat soft, is subjected to a minimum amount of stress during the transfer operation. The plate 32 is spring-biased in a clockwise direction, as viewed in FIG. 8, by a spring 44 acting on a plate 45 on the rear side of the plate 32. This spring bias urges the plate 32 against an adjustable stop 46 which is normally set to stop the plate 32 in a vertical position.

Figure 5B:
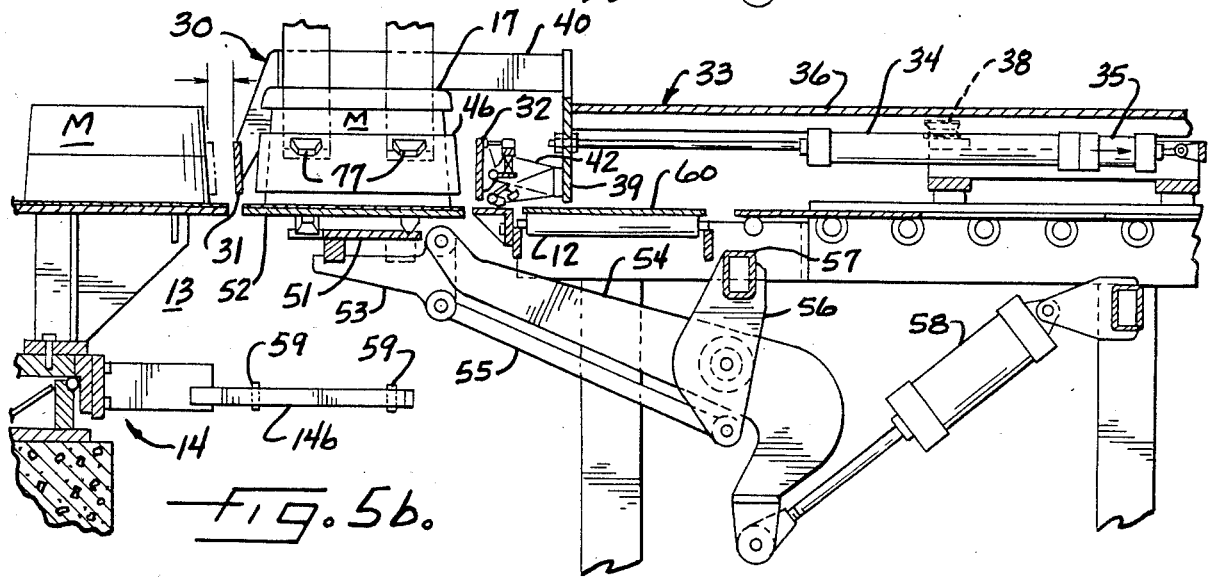

In order to clear the walls of the new mold on the elevator for application of the mold jacket 16 and weight 17, the transfer shuttle is retracted only slightly, by retracting the piston of the shorter cylinder 35. This intermediate retracted position of the shuttle, and its pusher plates 31, 32, is illustrated in FIG. 5*b*, which also shows the mold jacket and weight already in place on the new mold which has been transferred from the conveyor 12 to the elevator platform 51.

Following application of the mold jacket and weight, the mold elevator 50 is lowered to transfer the new jacketed and weighted mold to the lower tier of the turntable. During this downward movement of the elevator, the platform 51 again passes between the two spaced mold-supporting arms 14*b* provided at each mold station in the lower tier of the turntable, thereby depositing the mold M and its support plate 52 on the arms 14*b*. These support arms 14*b*, and the interconnecting cross member 14*c*, carry three pins 59 which provide a three-point support for the mold and its plate 52.

Figure 5C:
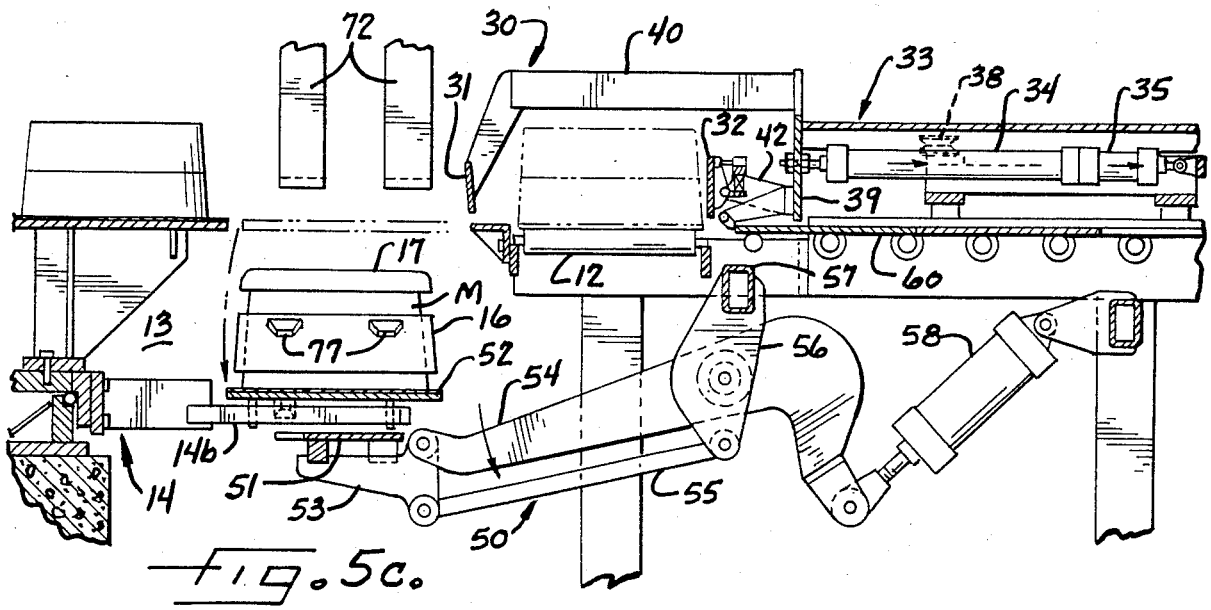
Figure 6:
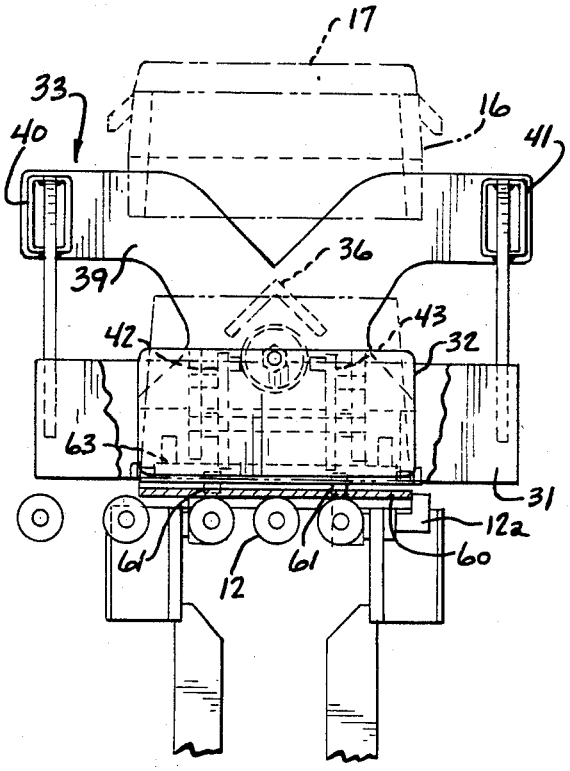
FIG. 6 is an enlarged section taken generally along line 6—6 in FIG. 3.
Figure 7:
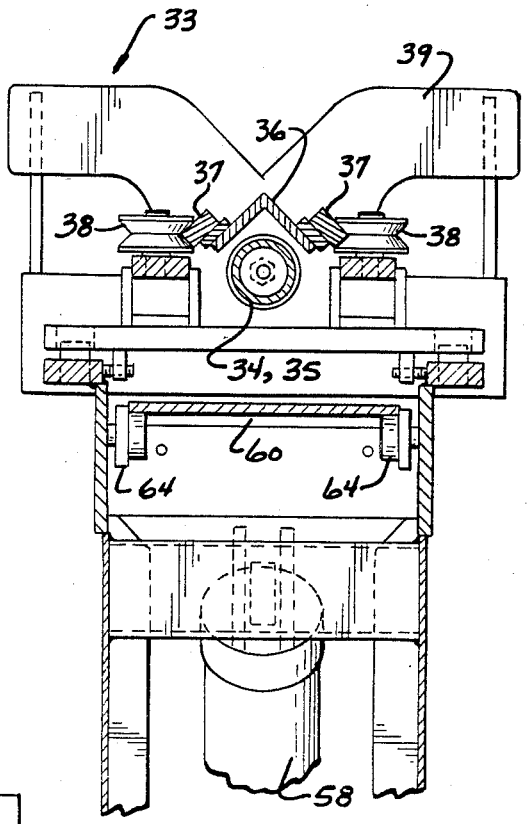
FIG. 7 is an enlarged section taken generally along line 7—7 in FIG. 3.
Figure 8:
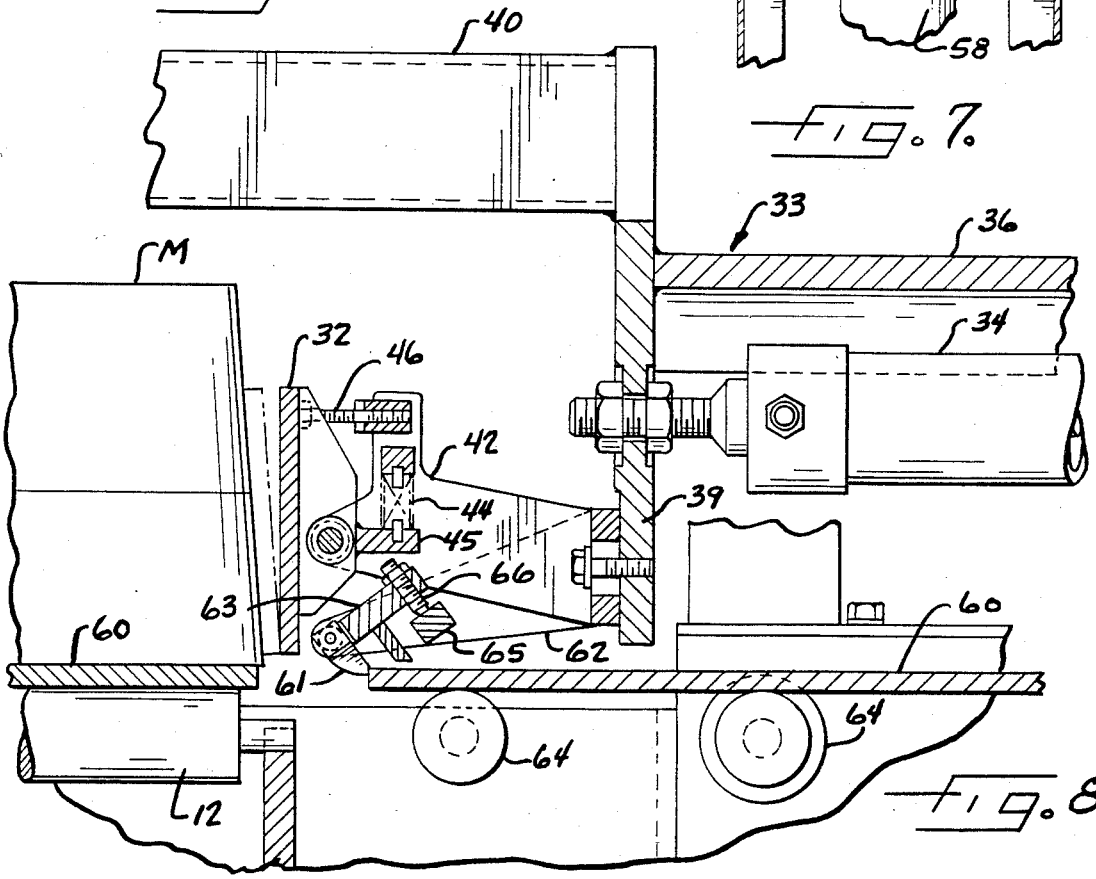
FIG. 8 is an enlarged view of a fragment of FIG. 4.
Figure 9:
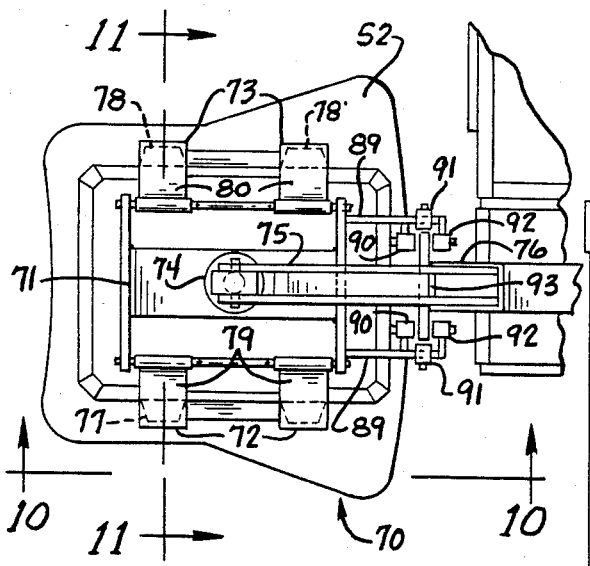
FIG. 9 is an enlarged top plan view taken generally along line 9—9 in FIG. 2.
Figure 10:
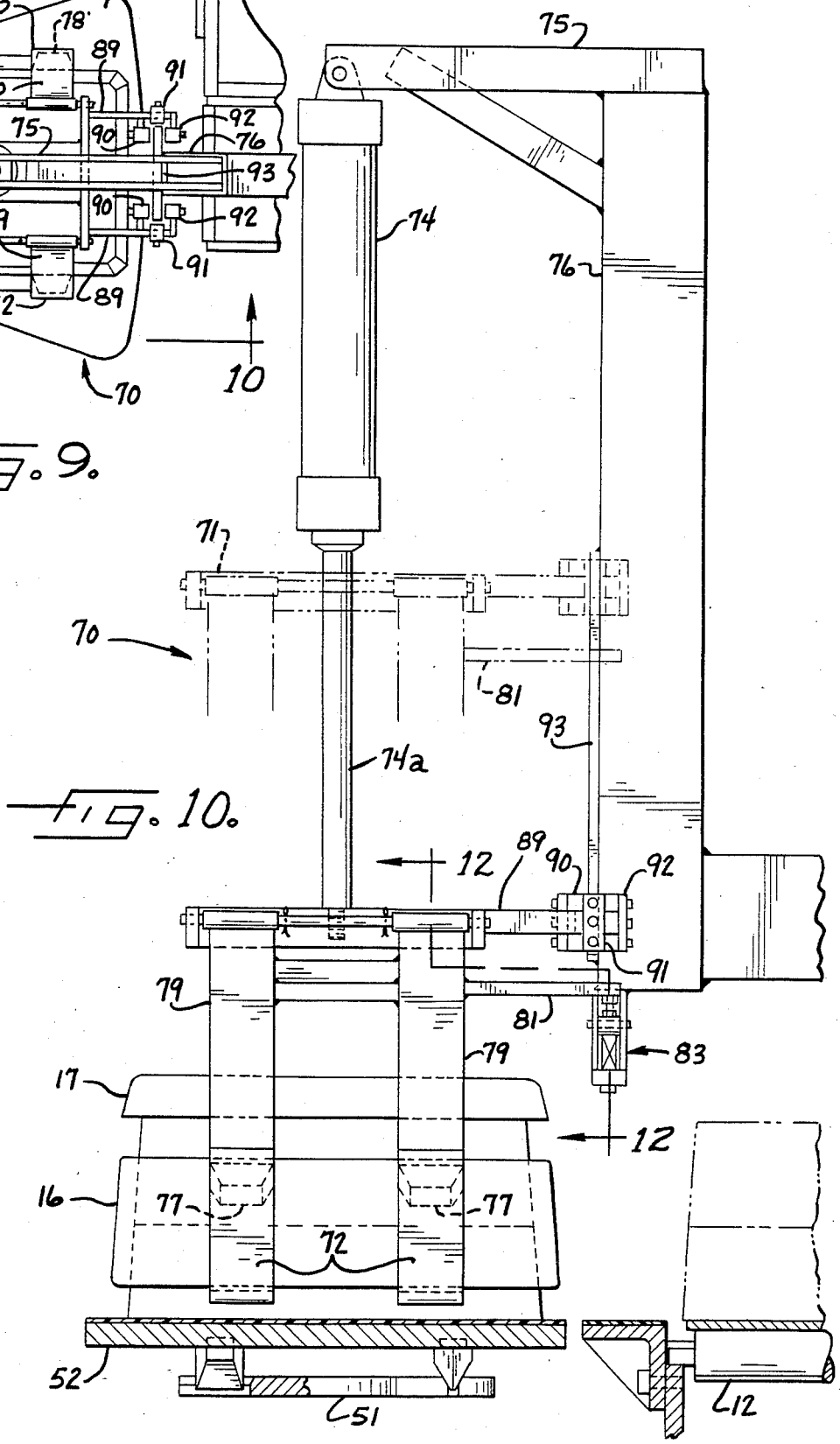
FIG. 10 is an enlarged side elevation taken generally along line 10—10 in FIG. 9.

After the elevator mechanism 50 has lowered the new mold onto the lower tier of the turntable, the transfer shuttle 30 is retracted to its fully retracted position by retracting the piston of the longer cylinder 34. This fully retracted position of the transfer shuttle is shown in FIG. 5*c*, which also shows the elevator mechanism 50 in its lowermost position. In this lowered position, the elevator platform 51 is located below all the mold-supporting arms 14*b* in the lower tier of the turntable so as to allow a clear path for indexing movement of the turntable.

When foundry molds are transported along roller conveyors, it is conventional practice to place each mold on a reusable board which supports the mold and protects it from being damaged by the conveyor mechanism. Thus, each time a new mold arrives at the transfer station 13, it is riding on a board 60 which must be recycled. For this purpose, a pair of shoes 61 are carried on a pair of arms 62 cantilevered from the carriage cross plate 39 between the arms 42 and 43 which carry the rear pusher plate 32. These shoes 61 are mounted on a cross plate 63 which is pivotally connected to the arms 62 so that the shoes 61 pivot upwardly when they are riding across the mold support plate 52 during reciprocating movement of the shuttle. When the shoes 61 clear the plate 52 during the retracting stroke of the shuttle, however, they pivot downwardly into engagement with the edge of the board 60 on the conveyor 12. Continued retracting movement of the shuttle then causes the shoes 61 to push the board 60 off the conveyor 12 onto a board-return conveyor 64.

To block pivoting movement of the shoes 61 while they are engaging the board 60, a stop bar 65 (FIG. 8) is fastened to the arms 62. This bar 65 is engaged by an adjustable screw 66 threaded through the upper end of the cross plate 63, thereby limiting pivotal movement of the bar 65 and shoes 61 in the clockwise direction, as viewed in FIG. 8.

As the transfer shuttle is retracted, the shoes 61 engage the board on which the new mold was riding when it arrived at the transfer station on the conveyor 12, and push that board off the conveyor 12 onto a board-return conveyor 67. The boards 60 are successively moved along this conveyor 67 until they drop into a collection device 68 at the end of the conveyor (see FIG. 2).

For the purpose of transferring the mold jacket 16 and weight 17 from the old mold raised by the elevator mechanism 50, onto the new mold loaded onto the elevator, a jacket transfer mechanism 70 is mounted directly above the elevator platform 51 at the transfer station 13. Referring to FIGS. 9–12, this jacket transfer mechanism 70 comprises a rectangular frame 71 carrying two pairs of depending hooks 72 and 73. The frame 71 and the hooks 72, 73 are raised and lowered by a pneumatic cylinder 74 which has its piston rod 74*a* connected to the rectangular frame 71; the top end of the cylinder 74 is connected to a stationary cross beam 75 mounted on a fixed column 76.

Each time the mold elevator 50 lifts a mold M from the lower tier of the turntable 14 up to the level of the upper tier, the cylinder 74 is actuated to raise the two pairs of hooks 72 and 73. As the hooks are raised, they engage two pairs of ears 77 and 78 projecting from opposite sides of the jacket 16 on the mold carried by the elevator platform 40. Continued upward movement of the hooks 72 and 73 lifts the jacket 16 upwardly against the underside of the mold weight 17, and then further upward movement of the hooks lifts both the jacket and the weight off the mold. The fully elevated position of the hooks 72, 73, and the mold jacket 16 and weight 17 carried thereby, is illustrated in FIG. 5*a* and is also shown in phantom in FIG. 11.

After the new mold has been transferred onto the elevator platform 51, as illustrated in FIG. 5*a*, the hydraulic cylinder 74 is actuated to lower the two pairs of hooks 72 and 73 to place the mold jacket 16 and weight 17 on the new mold.

Figure 11:
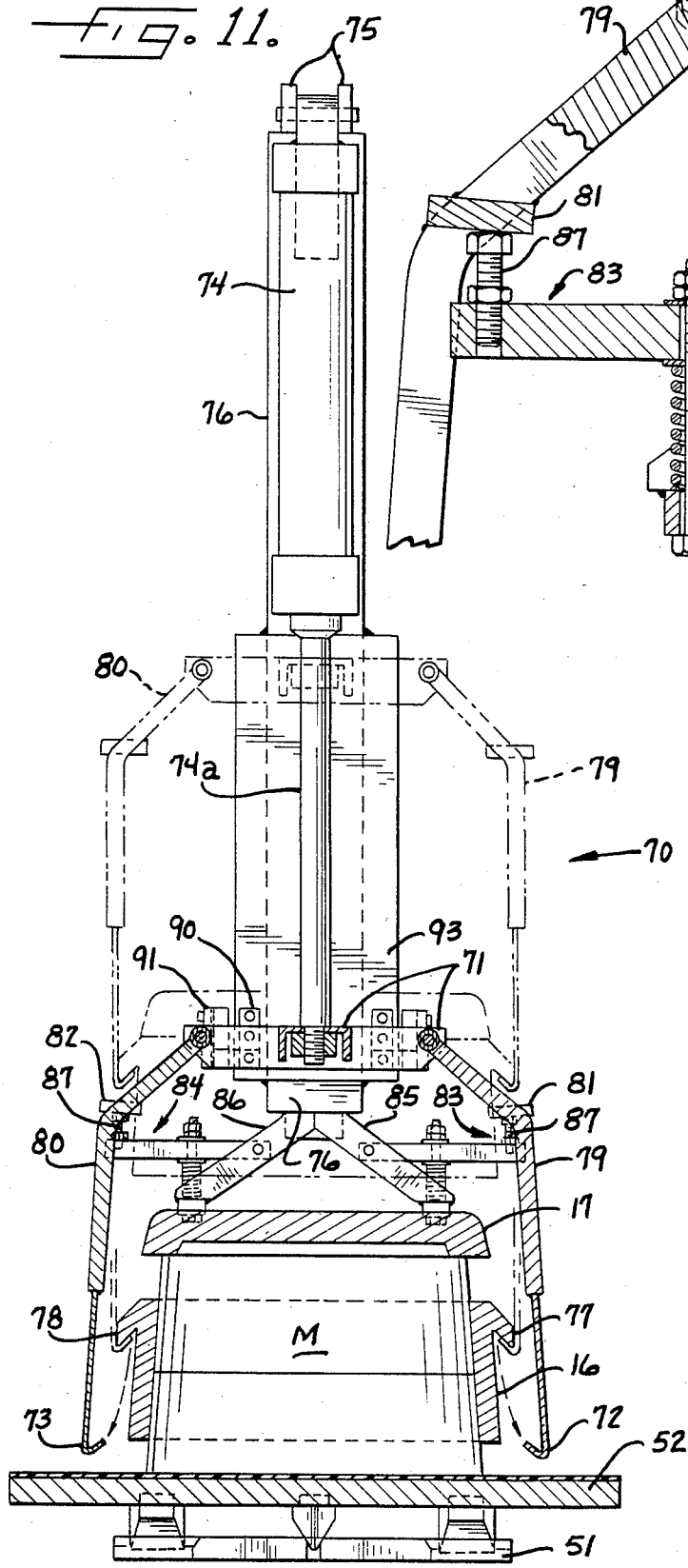
FIG. 11 is an enlarged section taken generally along line 11—11 in FIG. 9.
Figure 12:
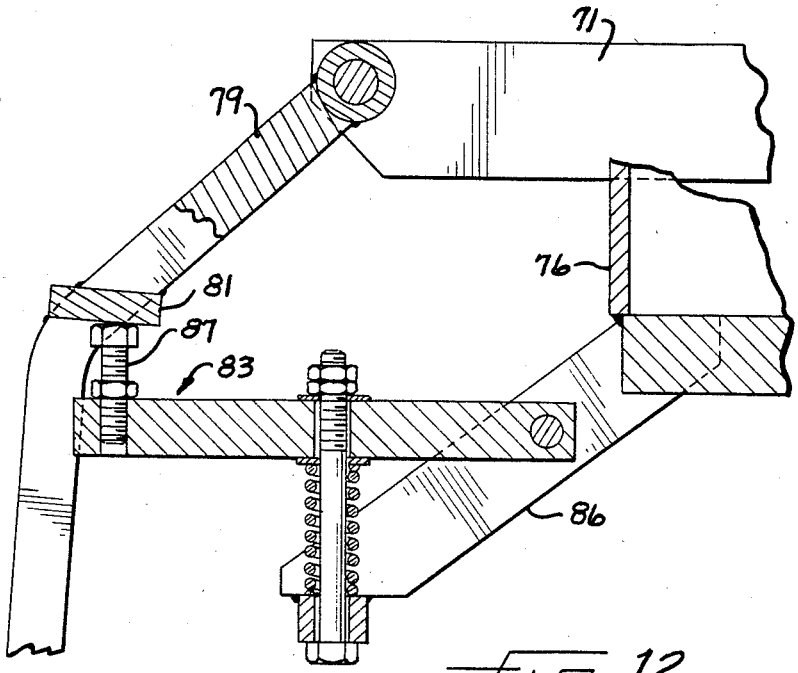
FIG. 12 is an enlarged section taken generally along line 12—12 in FIG. 10.

Returning to FIGS. 9–12, in order to release the hooks 72 and 73 from the jacket, and clear the downward path to be followed by the mold on the elevator platform 51 when the elevator mechanism 50 is lowered, the jacket transfer mechanism 70 includes means for displacing the hooks outwardly away from the mold jacket in response to continued downward movement of the hooks after they have placed the jacket on the new mold. This outward displacing movement of the hooks is illustrated in FIGS. 11 and 12. In FIG. 11, the hooks are shown in phantom in their fully elevated position; in dashed lines in their intermediate position where the jacket is first fully seated on the mold; and in solid lines in their fully lowered and outwardly displaced position.

To effect the outward displacement of the two pairs of hooks 72 and 73, the arms 79 and 80 which carry the hooks are pivotally connected to the rectangular frame 71 and carry a pair of plates 81 and 82 for engaging a corresponding pair of spring-loaded stops 83 and 84. These stops are pivotally mounted on two pairs of arms 85 and 86 fastened to the bottom of the column 76, and include adjustment screws 87 and 88 which engage the undersides of the plates 81 and 82 carried by the hook arms. As will be apparent from FIGS. 11 and 12, the vertical positions of the heads of these adjustment screws 87 and 88 are located to be engaged by the plates 81 and 82 after the hooks 72 and 73 have been lowered below the ears 77 and 78 of the mold jackets.

After the plates 81 and 82 engage the stops 83 and 84, further downward movement of the rectangular frame 71 causes the hook arms 79 and 80 to pivot outwardly away from the mold jacket, as illustrated by the arrows leading to the solid-line positions of the hooks in FIG. 11. As long as the hooks remain in this splayed condition, the jacketed mold has a clear path for downward movement to the lower tier of the turntable when the mold elevator mechanism 50 is lowered.

In order to stabilize and guide the jacket transfer mechanism 70 during its vertical travel, the rectangular frame 71 carries a pair of cantilevered arms 89, each of which in turn carries a set of three guide pads 90, 91 and 92 which ride on a vertical guide plate 93 mounted on the column 76. This guide plate 93 extends laterally from both sides of the column 76 so that the vertical edges of the plate are exposed for engagement by the guide pads 90, 91 and 92. This guiding arrangement provides a fixed vertical path for the lifting and lowering movement of the rectangular frame 71 so that the mold jacket carried on the hooks 72 and 73 is always properly aligned with the mold on the elevator platform 51.

Figure 13:
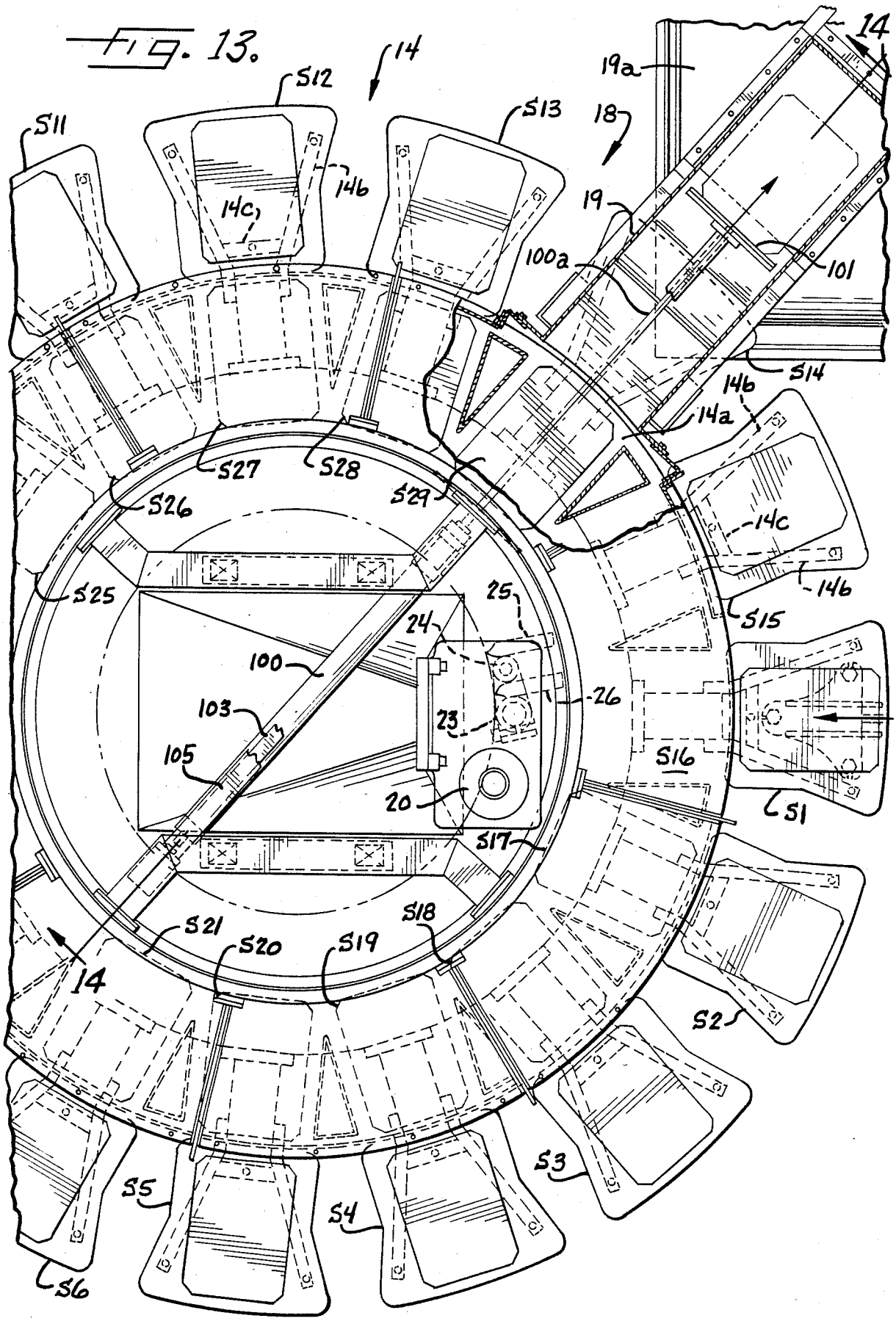
FIG. 13 is an enlarged top plan of a fragment of the system shown in FIG. 1.
Figure 14:
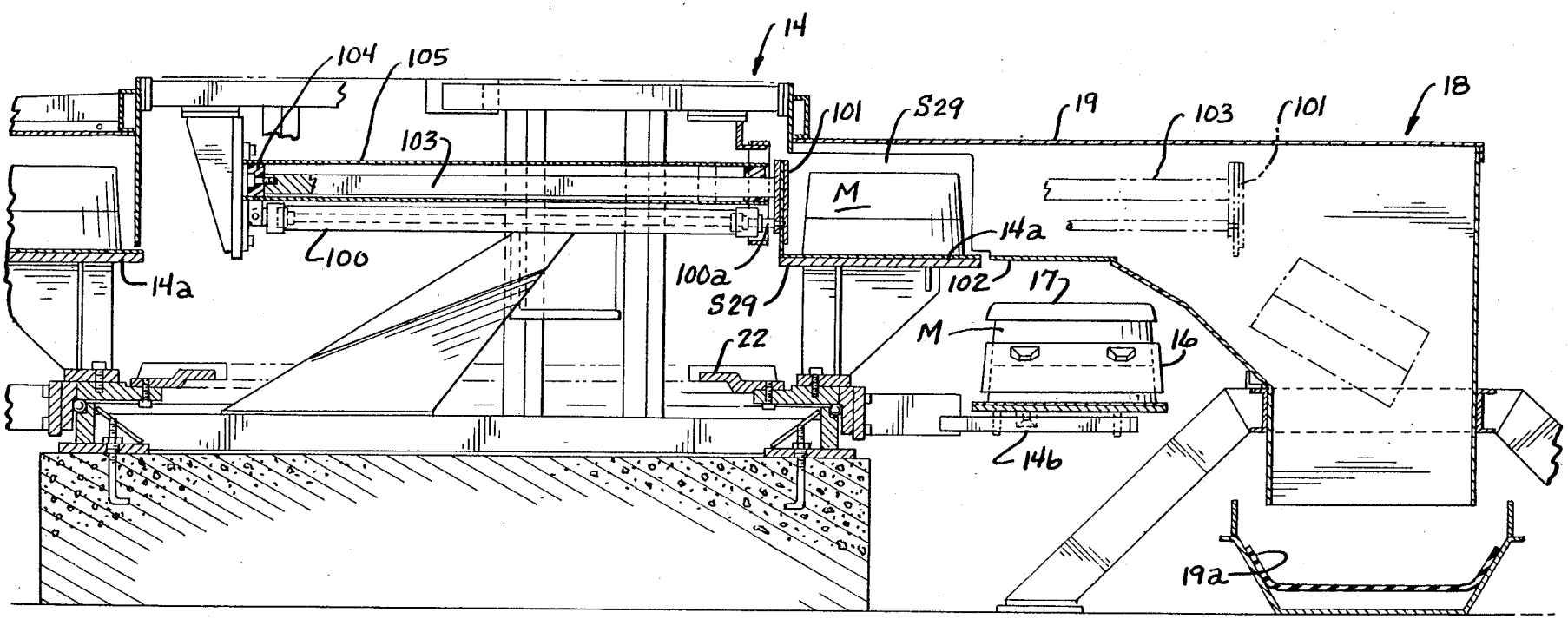
FIG. 14 is a section taken generally along the line 14—14 in FIG. 13.

The discharge station 18 is shown in more detail in FIGS. 13 and 14. This discharge station is located at station S29 of the inner circle of molds, which means that the mold discharged from this station has been on the turntable for twenty-eight indexing movements before it is discharged. By this time, the metal in most castings will be fully solidified. To discharge the mold, a pneumatic cylinder 100 is mounted diametrically across the open central portion of the annular turntable 14. A pusher plate 101 is fastened to the end of the piston rod 100*a* of the cylinder 100 so that when the piston rod is extended, it pushes the mold located at station S29 radially outwardly across a bridge plate 102 spanning the outer ring of molds on the turntable. The bridge plate 102 leads into the discharge chute 19 which guides the discharged mold outwardly and downwardly to the conveyor 19*a* for delivery to a conventional shakeout mechanism.

In order to stabilize the reciprocal movement of the piston rod 100*a* and the pusher plate 101, the pusher plate is also fastened to the end of an elongated guide rod 103. The inboard end of this guide rod 103 is fastened to a polymeric piston 104 which rides along the inside walls of a guide tube 105. This guiding arrangement ensures stable movement of the discharge mechanism back and forth along a fixed radial path.

As can be seen from the foregoing detailed description, this invention provides an improved automated mold handling system which is highly efficient and capable of providing a high level of productivity. The various mechanisms for transferring the molds and the mold jackets and weights are fast-acting and provide reliable operation over a long operating life. Furthermore, this system significantly reduces the possibilities of damaging the molds during their handling, even if the new molds supplied to the system happen to be in a relatively soft condition. Adjacent or consecutive molds are never brought into contact with each other, which further insures against mold damage.

I claim as my invention:

1. A mold handling system comprising an indexing turntable for carrying a multiplicity of molds in concentric inner and outer rings with the outer ring located at a lower elevation than the inner ring, a conveyor for transporting a multiplicity of molds to a mold transfer station adjacent said turntable, said transfer station including a mold transfer shuttle having a tandem pair of pusher plates of simultaneously (1) transferring a mold from the radial location of said outer ring of molds to the radial location of said inner ring of molds on said turntable, and (2) transferring a new mold from said conveyor to the radial location of said outer ring of molds, said pusher plates directly engaging the respective molds transferred thereby, an elevator mechanism for transporting molds back and forth between said different elevations, the upard movement of said elevator mechanism lifting a mold from said outer ring to the elevation of said inner ring so that said shuttle mechanism transfers the lifted mold directly from said elevator mechanism to said inner ring while simultaneously transferring a new mold from said conveyor onto said elevator mechanism, and the downward movement of said elevator mechanism lowers said new mold into said outer ring, a pouring station adjacent said turntable at a position downstream of said transfer station for filling the molds on the turntable with molten metal, and a mold discharge station for removing molds from said turntable.

2. A mold handling system as set forth in claim 1 wherein said discharge station includes for removing molds from said inner ring of molds.

3. A mold handling system as set forth in claim 1 which includes a board-return conveyor for transporting mold support boards away from said transfer station, and said transfer shuttle includes means for pushing said boards onto said board-return conveyor during each retracing movement of said shuttle.

4. A mold handling system as set forth in claim 1 wherein said mold discharge station includes means for removing molds from said inner ring in a radially outward direction, over the molds in said outer ring.

5. A mold handling system as set forth in claim 1 which includes jacket transfer means for lifting a jacket off a mold to be removed from said outer ring of molds, and then placing said jacket on a new mold to be added to said outer ring.

6. A mold handling system as set forth in claim 5 wherein said jacket transfer means is arranged to lift a jacket off a mold carried by said elevator mechanism and to place said jacket on a new mold loaded onto said elevator mechanism.

7. A mold handling system as set forth in claim 6 wherein said jacket transfer means includes means for releasing a jacket placed on a new mold so that the mold can be moved to a different elevation by said elevator mechanism.

8. A mold handling system as set forth in claim 1 which includes jacket transfer means for lifting a jacket off a mold to be removed from said outer ring of molds, and then placing said jacket on a new mold to be added to said outer ring; and means for retracting said shuttle mechanism to an intermediate position after a new mold has been transferred from said conveyor to said elevator mechanism, said intermediate retracted position providing a clearance around said new mold to allow said jacket to be placed thereon.

* * * * *